US006182541B1

(12) United States Patent
Anderson et al.

(10) Patent No.: US 6,182,541 B1
(45) **Date of Patent: *Feb. 6, 2001**

(54) MULTIPLE DRIVER AND PLIERS HANDTOOL

(76) Inventors: Wayne Anderson, 65 Grove St., Northport, NY (US) 11768; Paolo Cassutti, 8 N. Creek Rd., Northport, NY (US) 11729

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/237,565

(22) Filed: Jan. 26, 1999

Related U.S. Application Data

(60) Division of application No. 08/904,666, filed on Aug. 1, 1997, which is a continuation-in-part of application No. 08/451,398, filed on May 26, 1995, now Pat. No. 5,711,194, which is a continuation-in-part of application No. 08/620,471, filed on Mar. 22, 1996, now abandoned.

(51) Int. Cl.[7] ..... B25B 23/00

(52) U.S. Cl. ..... 81/440; 81/439; 7/118; 7/165; 7/168

(58) Field of Search ..... D3/228; 224/681–683; 7/118, 165, 127–129, 131, 167–168, 125, 139, 142, 158; 81/437–440, 177.4, 177.6, 177.85, 124.5, 490

(56) References Cited

U.S. PATENT DOCUMENTS

| | | | | |
|---|---|---|---|---|
| 4,448,097 | * | 5/1984 | Rocca | 81/439 |
| 5,251,353 | * | 10/1993 | Lin | 7/128 |
| 5,267,366 | * | 12/1993 | Frazer | 7/128 |
| 5,533,429 | * | 7/1996 | Kozak | 81/439 |
| 5,664,274 | * | 9/1997 | Collins | 7/129 |
| 5,809,600 | * | 9/1998 | Cachot | 7/128 |

* cited by examiner

*Primary Examiner*—D.S. Meislin
(74) *Attorney, Agent, or Firm*—Lackenbach Siegel Marzullo Aronson & Greenspan

(57) ABSTRACT

A hand tool having a plurality of tools attached thereto. The tool includes a sleeve with a plurality of bits. The sleeve is disconnectably attached to a handle by engagement with a polygonal socket connection drive which is pivotally attached to the handle. A second tool is pivotally attached to the handle opposite end.

8 Claims, 19 Drawing Sheets

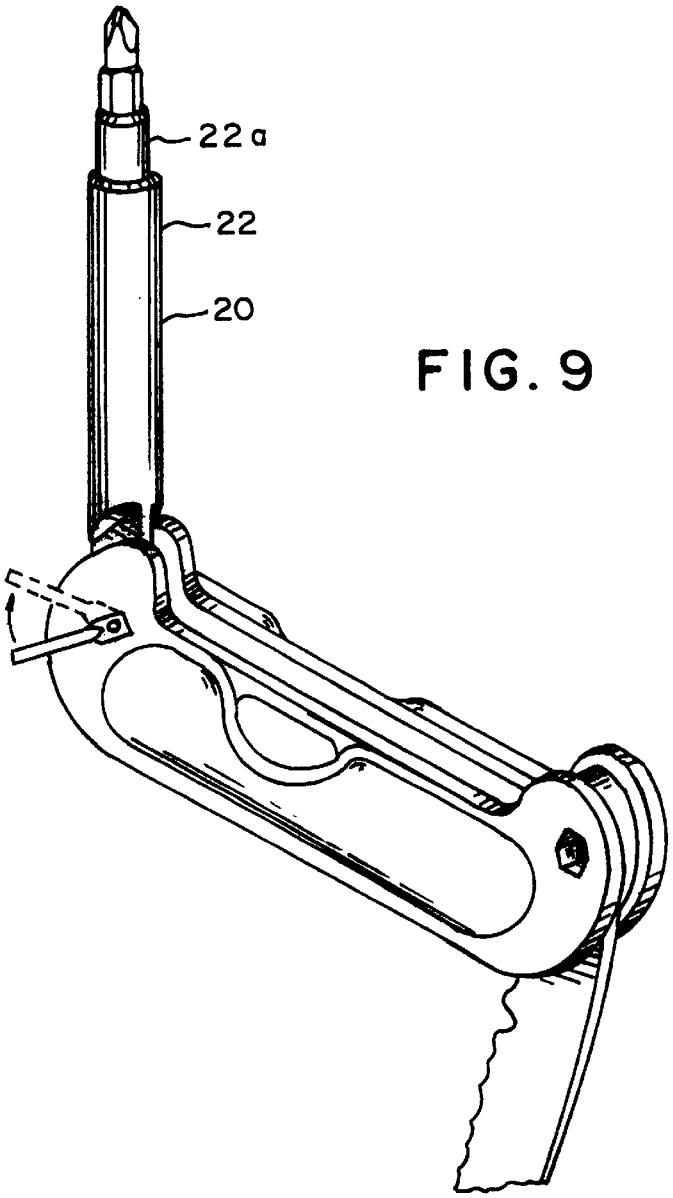
FIG. 9
FIG. 10
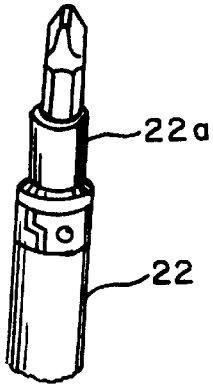
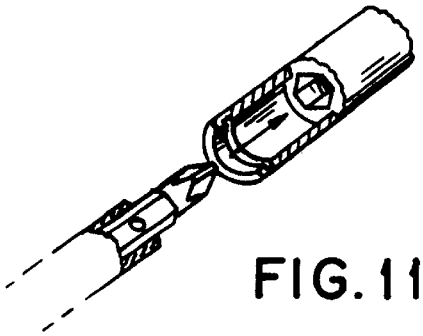
FIG. 11
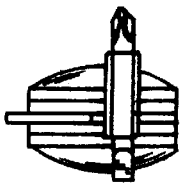
FIG. 8

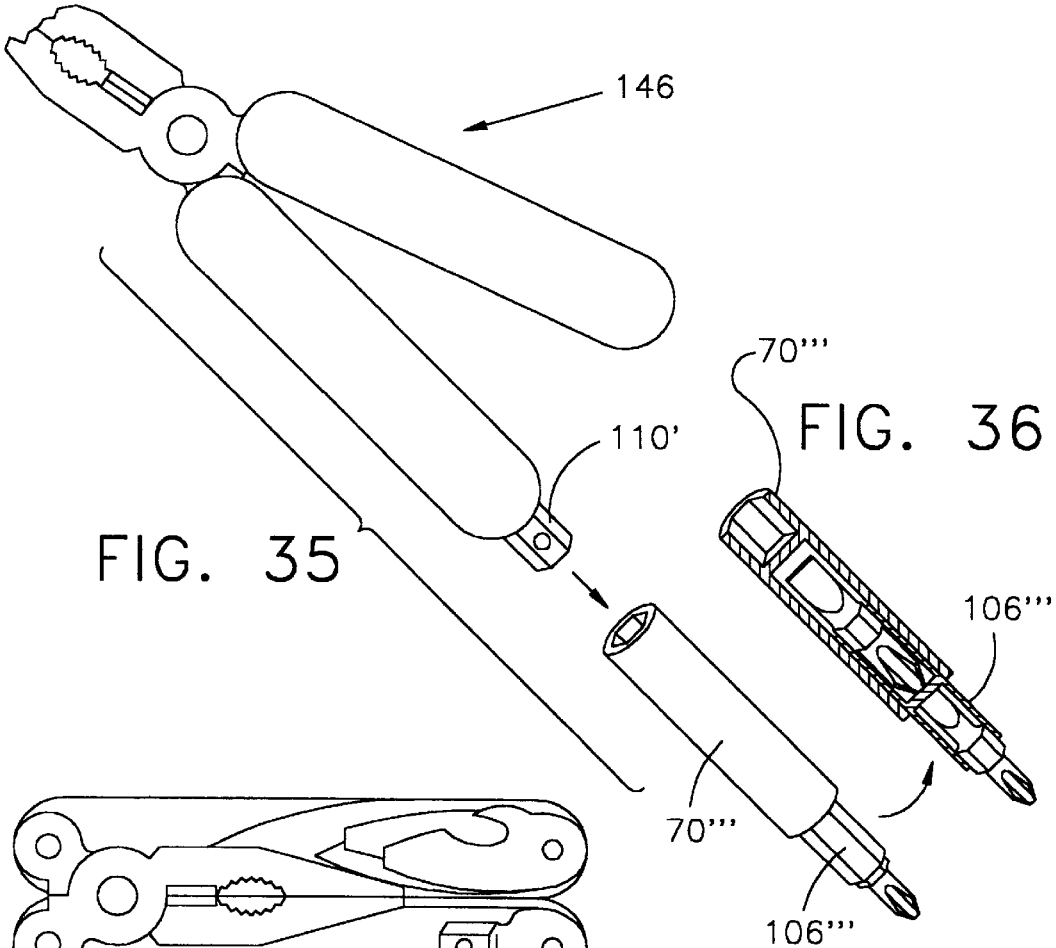
FIG. 35
FIG. 36
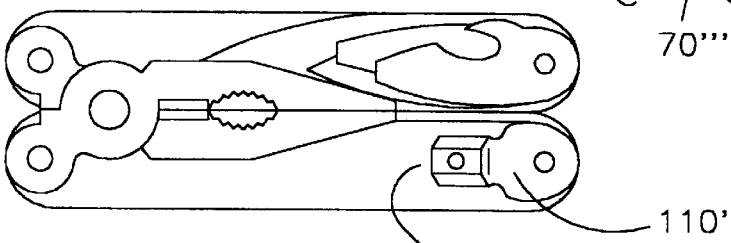
FIG. 37
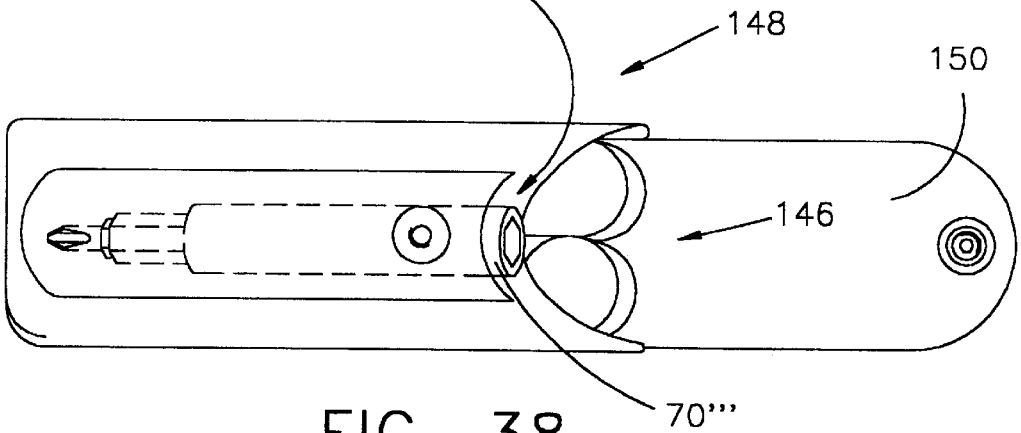
FIG. 38

MULTIPLE DRIVER AND PLIERS HANDTOOL

This application is a division of U.S. Ser. No. 08/904,666, filed Aug. 1, 1997 and a continuation-in-part of U.S. Ser. No. 08/620,471, filed Mar. 22, 1996 abandoned, and a continuation-in-part of Ser. No. 08/451,398 filed May 26, 1995, now U.S. Pat. No. 5,711,194, granted Jan. 27, 1998.

BACKGROUND OF THE INVENTION

The present invention pertains to improved multipurpose hand tools, and more particularly to a Leatherman's type hand tool or Swiss army knife, but with improved features, such as an interchangeable 4 in 1 or screw nut driver even an 8 in 1 driver tool, as well as other novel improved wrench and plier hand tools.

Incorporation of multiple tool functions or abilities into a single tool device is a well known convenience as is incorporation of multiple blades and tools which may be designed to "fold" into a handle, such as in a conventional pocket knife configuration. Such blades and tools do not themselves generally fold, but are hinged to the handle and the combination blade and handle are said to fold closed for safe and convenient transport and unfold, or hinge open, for use. In such conventional pocket knife configurations as are known to the applicant, each blade and tool function is represented by a single operative member, such as a knife blade or a screwdriver blade, which are combined in some stacked arrangement to hinge with respect to the handle. On the other hand, multipurpose tools are known which do not fold, such as interchangeable bit screwdrivers, wrenches, pliers, etc.

SUMMARY OF THE INVENTION

The present invention provides a self-contained, improved hand tool having no loose parts, such as folding pocket-type knives with the flexibility and functionality of multipurpose tools. The present invention provides, among other hand tools, a folding combination pocket-type knife with the professional usefulness of interchangeable bit screwdrivers and offset screwdrivers using the same interchangeable bit. In particular, the present invention provides hinged sleeve means which removably retains screwdriver bits in hinged relationship to a handle adapted to receive the sleeve and bit in recessed storage relationship and in exposed An functioning relationship. The sleeve means has retaining means which cooperates with the bit to removably secure the bit in the sleeve. The double ended bit is interchangeable with other bits and is reversible, having a different drive at each end.

Also provided is an hexagonal cross-hole, extending from one side bolster to the other of the handle, to receive the interchangeable bits in perpendicular relation to the handle, creating an offset interchangeable bit section of the invention. Retractable and/or biasable ball retaining means, or magnets, or retaining clips on each interchangeable bit may be used to retain the offset bit by fitting between the side bolsters and being retained thereby. Also, with the various hand tools of the invention, the folding blades may suitably have conventional provisions for locking in the open positions any of the tools for safety so as to prevent tools and blades from unexpectedly snapping closed.

BRIEF DESCRIPTION OF THE DRAWINGS

FIG. 8 is an end view of the folding knife and interchangeable bit screwdriver of the invention shown in FIG. 7.

FIG. 9 is a perspective view of the folding knife and interchangeable bit screwdriver of the invention shown in FIG. 6.

FIG. 10 is a fragmentary perspective view of the sleeve-in-sleeve and bit of the folding knife and interchangeable bit screwdriver of the invention.

FIG. 11 is a fragmentary perspective view, partly broken away, of a bit being inserted into the sleeve-in-sleeve of the folding knife and interchangeable bit screwdriver of the invention.

FIGS. 35–37 are views similar to that of FIGS. 15 and 19, but showing a long nose pliers both with a fixed end connection as well as with a pivotable end connection with a removably connected "chuck" or driver element (FIG. 37) for a hexagonal driver having dual hexagonal bits at opposite ends thereof; with FIG. 37 showing removal of the driver tool element when the tool is folded for storage due to the length of the jaws of the pliers.

FIG. 38 illustrates a storage case with a pair of pockets, one for storing the folded tool of FIG. 37, and the other smaller one for storing the removable "chuck" or driver element.

DESCRIPTION OF THE PREFERRED EMBODIMENTS

Figure 1:
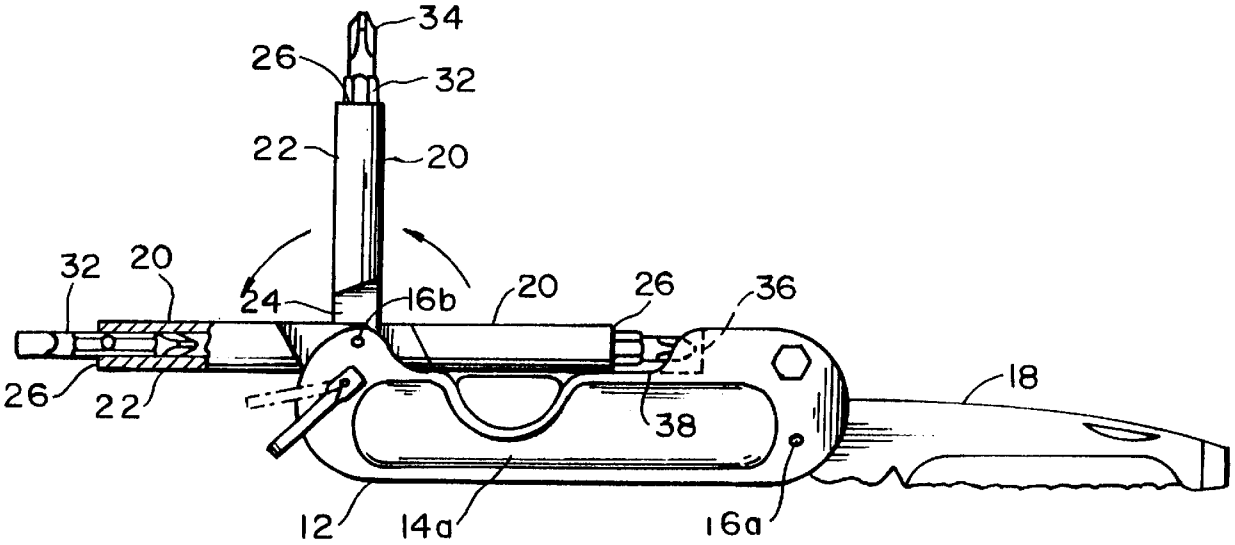
FIG. 1 is plan view of the folding knife and interchangeable bit screwdriver of the invention showing the sleeve and bit in closed and operative positions and a knife blade in operative position.
Figure 2:
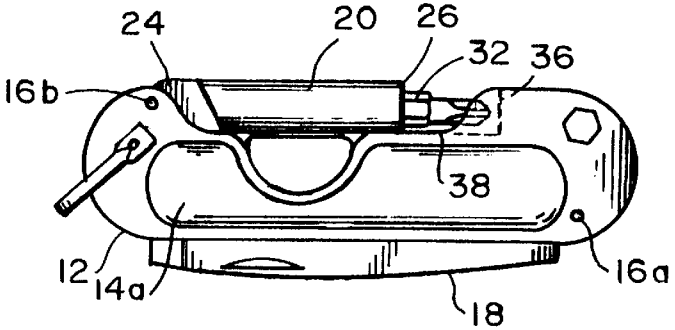
FIG. 2 is a plan view of the folding knife and interchangeable bit screwdriver of the invention as shown in FIG. 1 in closed position.
Figure 4:
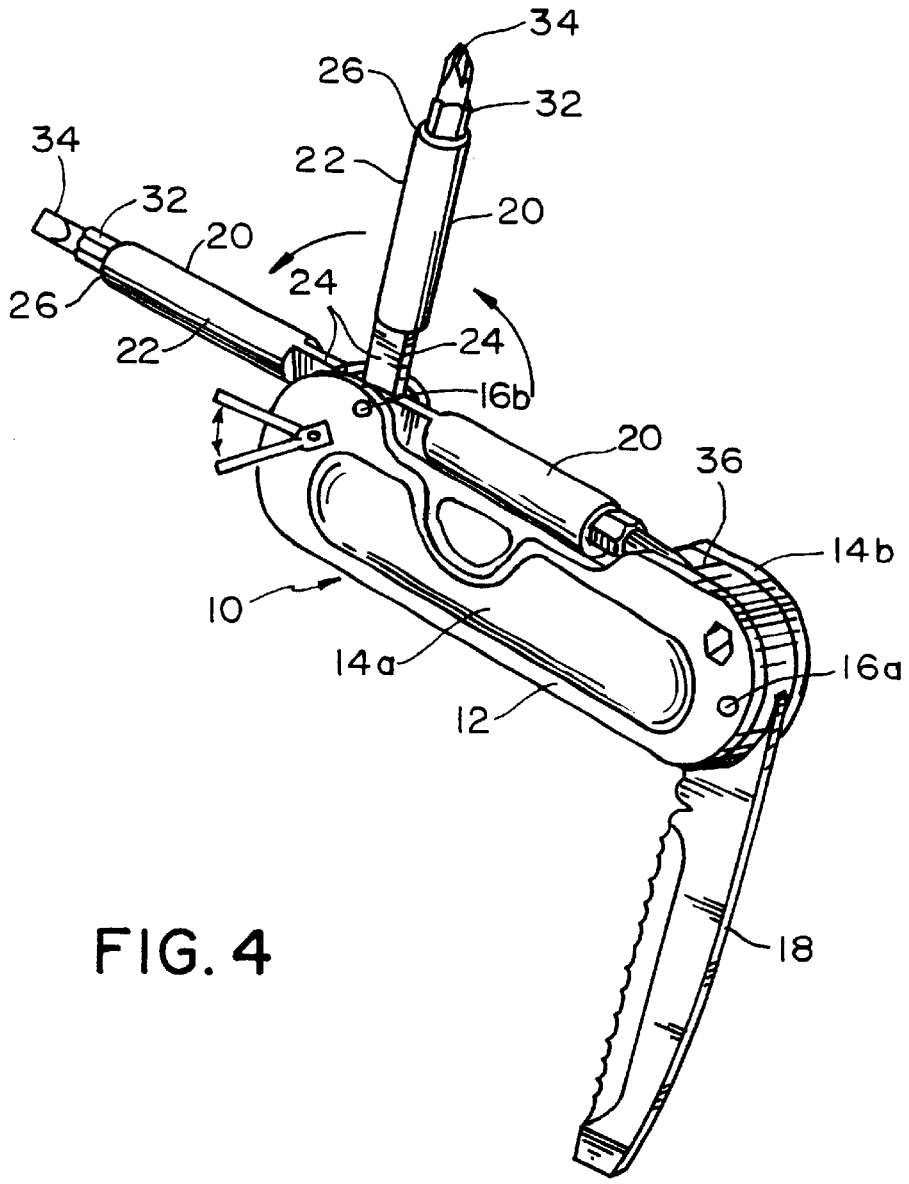
FIG. 4 is a perspective view of the folding knife and interchangeable bit screwdriver of the invention showing the sleeve and bit in closed and operative positions and a knife blade in partially open position.
Figure 3:
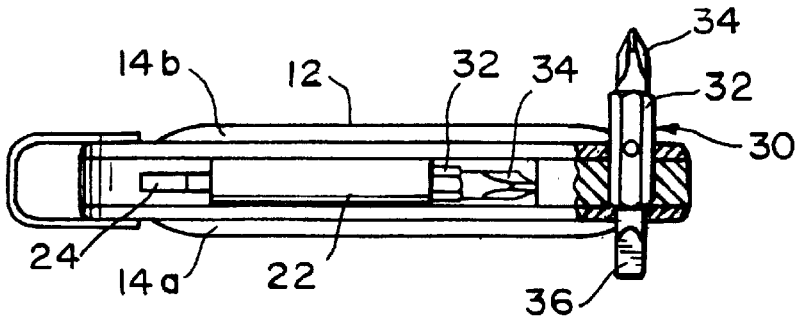
FIG. 3 is a top view of the folding knife and interchangeable bit screwdriver of the invention showing a screwdriver bit in offset position.

With reference to FIGS. 1–13 of the drawings, the folding knife and interchangeable bit screwdriver of the invention 10 comprises handle means 12 having a pair of spaced similarly shaped side bolsters 14*a* and 14*b*. A plurality of hinge pins 16*a* and 16*b* are provided, each traversing between side bolsters 14*a* and 14*b* and perpendicular to the longitudinal axis of handle means 12. In the preferred embodiment, at least one hinge pin is provided at each end of handle means 12. Rotatably attached to one hinge pin 16*a* is a knife blade 18 which swivels about hinge pin 16*a* from a closed position partly or entirely recessed in handle means 12, as shown in FIG. 2, to a partly open position as shown in FIG. 4, to a fully open and operative position as shown in FIG. 1.

Rotatably attached to hinge pin 16*b* is sleeve means 20, comprising hollow tube means 22 having a hinged end 24 and an open end 26 opposite hinged end 24. The interior of hollow tube means 22 is hexagonal in cross section.

Reversible screwdriver bit 30 comprises a central shoulder section 32 which is noncircular in cross section, preferably hexagonal, and is adapted to slidably fit within hollow tube means 22. Each end of reversible bit 30 has a screwdriver drive. As shown in the drawing, reversible bit 30 has a Phillips drive end 34 and a crosscut drive end 36, but any combination of useful screwdriver configurations may be used. The screwdriver ends are smaller in cross section than the cross section of shoulder section 32 to permit insertion into hollow tube means 22. Reversible bit 30 may be inserted into hollow tube means 22 with either end exposed for use and may be withdrawn and reversed for use of the opposite end. Sleeve means 20 is rotatable about hinge pin 16*b* from an open position, at any angle with respect to the longitudinal axis of handle means 12, or closed wholly or partially within a recess 36 provided in handle means 12 for the purpose.

Figure 6:
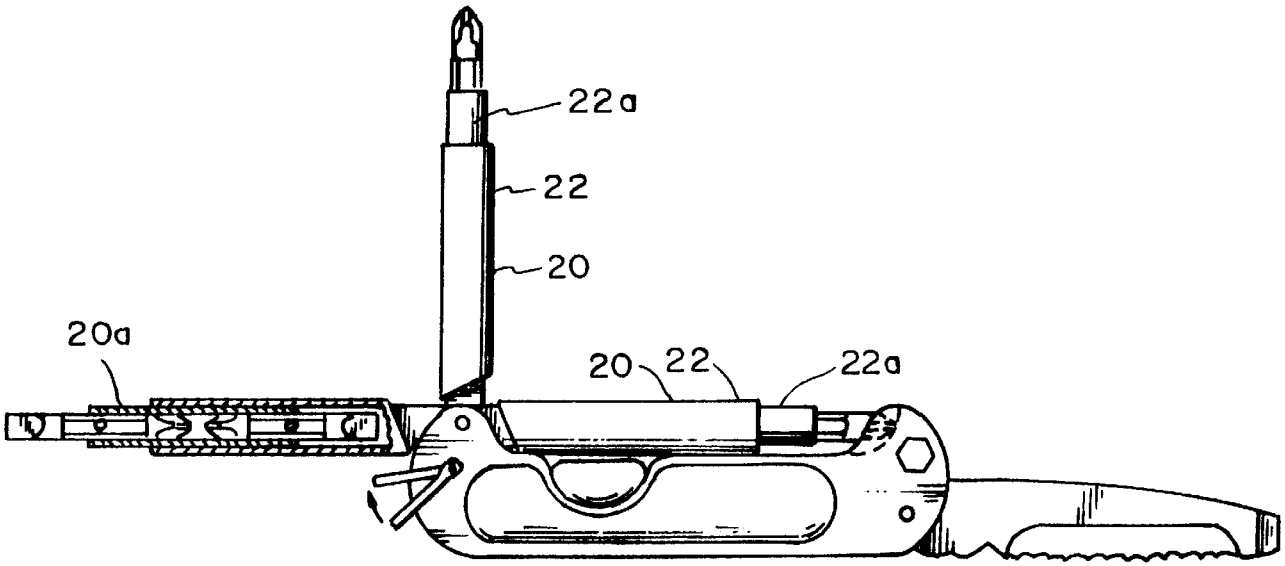
FIG. 6 is a plan view of the folding knife and interchangeable bit screwdriver of the invention showing a sleeve-in-sleeve version of the invention in closed and operative positions and partially broken away to show the internal construction, and a knife blade in operative position.
Figure 5:
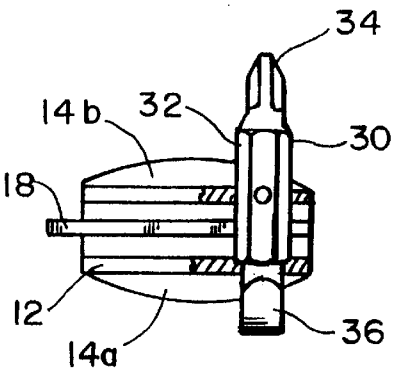
FIG. 5 is an end view of the folding knife and interchangeable bit screwdriver of the invention as shown in FIG. 3.

Retaining means are provided on each reversible bit 30 to removably retain each bit in hollow tube means 30. In the preferred embodiment, such retaining means comprise a spring-loaded ball 35. Means such as spring-loaded detents may be provided to retain hollow tube means 30 in closed, 90° open and 180° open positions as shown in FIGS. 1, 4 and 6. Reversible bits 30 may also be referred to as interchangeable bit means.

Side bolsters 14*a* and 14*b* are provided with a central depression 38 adapted to receive the user's fingers when using knife 18 to help prevent the fingers from sliding onto the knife blade. With appropriate location of hinge pin 16*b* adjacent depression 38, sleeve means 20 may close into depression 38 as well as into recess 36 when closed. Hingedly opening sleeve means 20 exposes depression 38 for use.

With one reversible bit 30, a 2-in-1 folding screwdriver means is provided. The invention also provides a 4-in-1 folding screwdriver means as shown in FIGS. 6–11. Sleeve means 20 is provided with an inner sleeve 22*a* which is slidably secured within hollow tube 22. Means are provided to prevent inner sleeve 22*a* from rotating relative to hollow tube 22, such as by having the exterior of inner sleeve 22*a* hexagonal in cross section to mate with the hexagonal interior of hollow tube 22. Inner sleeve 22*a* itself has a hexagonal interior adapted to receive and matingly engage shoulder section 32 of reversible bit 30 such that there is no relative rotational motion therebetween. Inner sleeve 22*a* is sufficiently long to receive two reversible bits 30 at the same time, yielding four bit ends for use by reversing either bit in inner sleeve 22*a*, or by reversing inner sleeve 22*a* in hollow tube 22.

Referring now, and more particularly, to FIGS. 14–45, there is shown a number of alternate and improved modifications and alternate constructions of the hand tool of the invention with various implements generally pivotably mounted to at least the distal end of one of the tool handles. More particularly, as shown therein, the hand tool of FIGS. 14–19 is very much like the conventional Leatherman's plier tool, made and sold by the United States company known as the Leatherman Tool Group, Inc. However, here the improved hand/survival tool 50 embodies a tool having no loose parts, in addition to other conventional tools, knives, etc., either in a 4 in 1 or an 8 in 1 screw-nut driver tool (4 in 1 shown) by the reference numeral 52, the only difference being that with the 8 in 1 tool, a longer handle would be required due to the need for a longer "master" inner sleeve 52, and a generally wider or bulkier handle due to the need for an outer holding sleeve and the reversible master inner sleeve and reversible "servant" sleeves having reversible driver tools and/or bit drivers, depending upon the length and diameter of the drive bits. It will be appreciated that the longer master or outer sleeve in an 8 in 1 tool securely holds and precludes rotation between itself and the shorter servant or inner sleeves of the pair of oppositely disposed 4 in 1 tool elements at the distal ends of the long inner sleeve. Nevertheless, it is also within the practice of the invention for the master and/or servant sleeves, as well as the screwdriver bits themselves to be either symmetrical or asymmetrical (long or short reach), similar to that disclosed in our copending U.S. patent application Ser. No. 08/620,471 incorporated herein by reference.

In FIGS. 14–19, the improved multipurpose hand tool 50 includes a pair of handles 54 and 56, which in the case of a Leatherman-like hand tool, both handles are pivotable to their respective jaws 58 and 60 at their front or proximal ends 62 and 64, with the movable jaws themselves being centrally pivotable about the tool's primary axis or pivot pin 66. While the jaws shown therein are illustrated as blunt at their ends ("cut-off" type), other various types of jaws are also applicable to the present invention, including the long nose type, where the jaws are generally more slender and elongated in shape, such as long nose pliers made and sold by the American Tool Companies of Kenosha, Wis., and DeWitt, Nebr., but without the over-toggle clamping means normally associated with a locking hand tool pliers.

Each of the folding handles 54 and 56 have a respective storage cavity 54' and 56' for storing a respective jaw 58 and 60, as well as the one or more tool implements pivotally mounted at the opposite distal jaw ends 66 and 68. One of the handles 54 may be suitably provided with either a 4 in 1 or 8 in 1 driver tool. In the illustrated embodiment of the improved hand tool of the invention, a 4 in 1 screwdriver 70 is shown, with its reversible sleeve or integral tube means 72 having a pair of reversible bits 73 and 75, removably seated at opposite ends in cavities or compartments, each reversible driver bit embodying a Phillips type screwdriver 74, 74' and a more conventional flat blade type screwdriver 76, 76' at opposite ends of the reversible bit driver. Both the reversible bits and the reversible sleeve or tube means 72 are suitably retained or held in place in their carriers by conventional means, such as biasable ball detents, suitable magnets, retaining clips, such as C or U-shaped and the like. In addition, as noted in the embodiments of FIGS. 1–13, means are provided to prevent the reversible sleeve 72 from rotating relative to the pivotable, outer hollow tube 52, such as by conventional grooves in the outer sleeve and mating ears on the inner sleeve, or as shown in said figures by having the exterior of the sleeve 72 hexagonal in cross section so as to mate with the hexagonal interior of the hollow tube 52.

Furthermore, the reversible sleeve 72 itself is also provided with a hexagonal interior for matingly receiving and engaging a shoulder section 32' of the reversible bits so that rotational motion may be transmitted from the handles to the hollow tube 52 to the reversible sleeve 72 and to the reversible bit, and thence to the fastener (not shown) being driven or removed from a wall or surface in which the fastener is located.

At the proximal tool end are located the pivotable and mating jaws 58 and 60, both of which are movable in synchronism with each other. Each is provided with a mating jaw face having a suitable knurl or other gripping means (not shown) and teeth 78 and 80 for gripping a nut, rod, pipe or other object, and a cutter with anvil 82 and 84.

The other handle 56 is suitably equipped with any number of other pivotable tools, such as knives, bottle openers, screwdrivers, ruler-file, serrated saw, blade, scissors, awl-punch, fish scaler, can opener, Phillips or slotted screwdriver and the like. As shown therein, the four tools are a bottle opener/flat screwdriver, another flat blade screwdriver, file and awl-punch.

Figure 20:
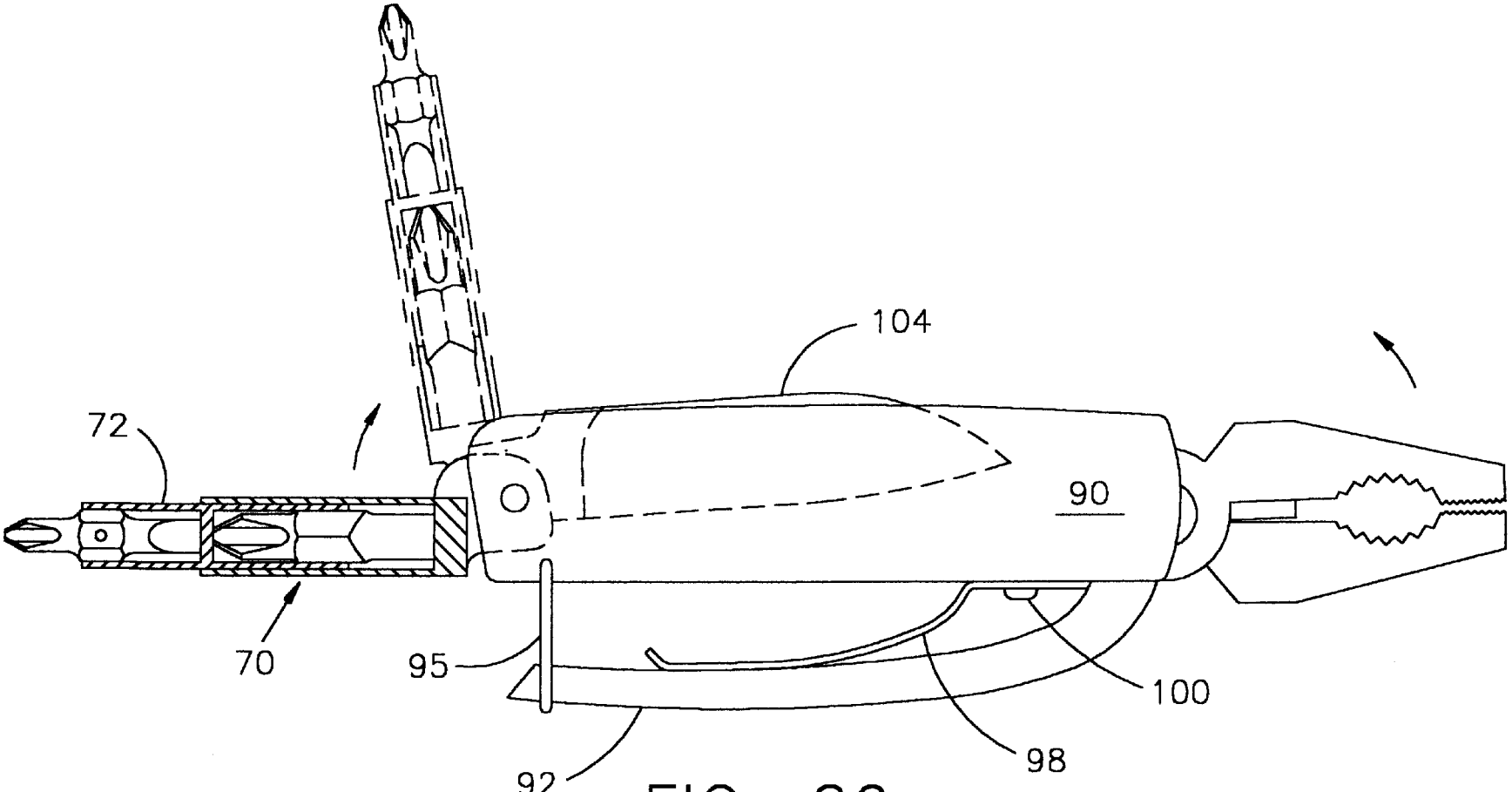
FIGS. 20–22 are various views, partly in section, of an alternative form of the improved hand/survival tool, but with only one large handle, having a cavity f or storing all of the tools (knife, 4 in 1 driver bit tool, etc.), except the pliers, with the other small handle operating the sole movable or pivotable jaw of the pliers.
Figure 21:
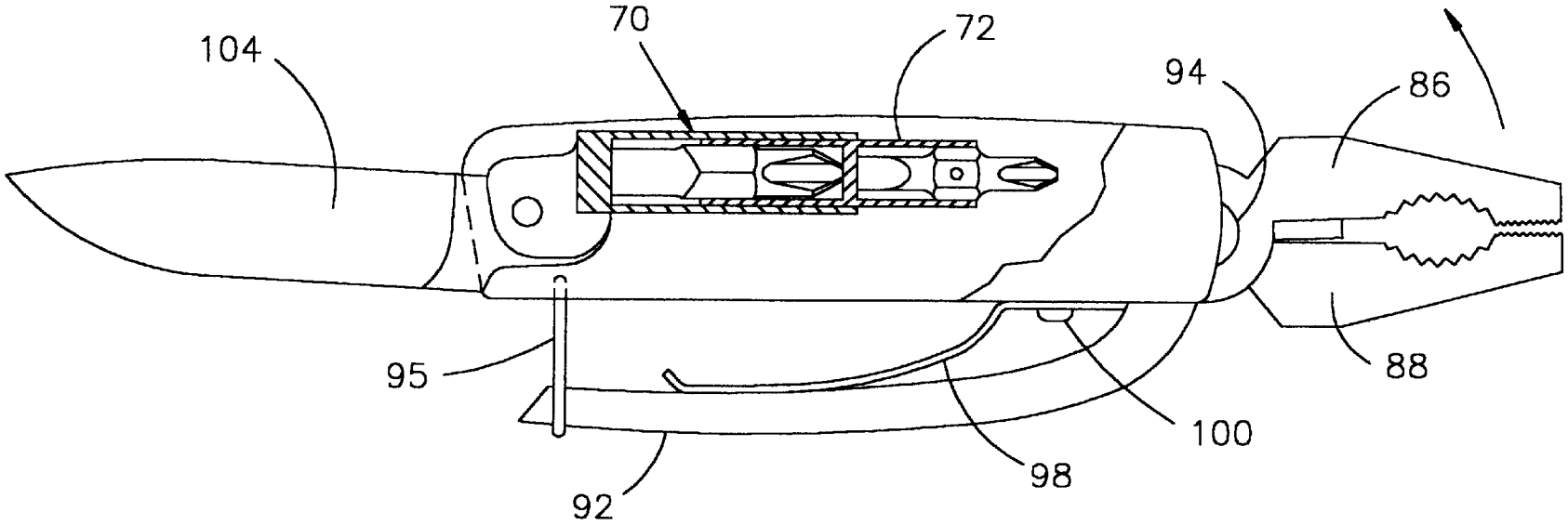
Figure 22:
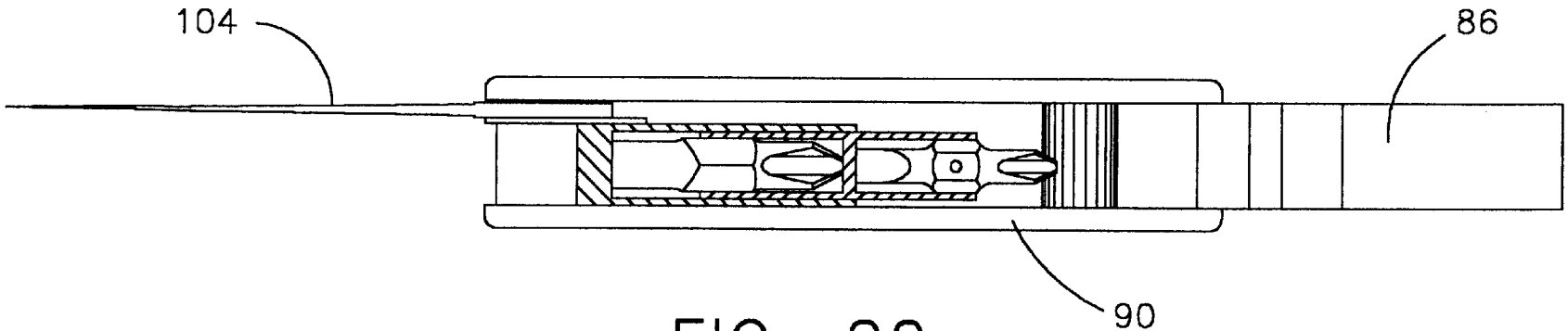

As best shown with like numerals, the tool of FIGS. 20–21, 21(A&B) and 22, illustrate another plier-like tool with a pivotable sleeve for a 4 in 1 driver tool, but with only one movable jaw 86 as shown by the reference arrow, the other jaw 88 being fixed to larger fixed handle 90. The movable handle 92 is pivotable about the fixed handle by means of axis point or pivot pin 94 and such handle is suitably held in the closed position by a pivotable U-shaped element 96 which may also serve as a loop for holding the improved hand tool to one's belt loop or chain attached to a pair of pants. Optionally, a spring element 98 may be secured to the handle 90 by means of fastener 100 to biasably urge the movable jaw 86 to an open position.

Figure 21A:
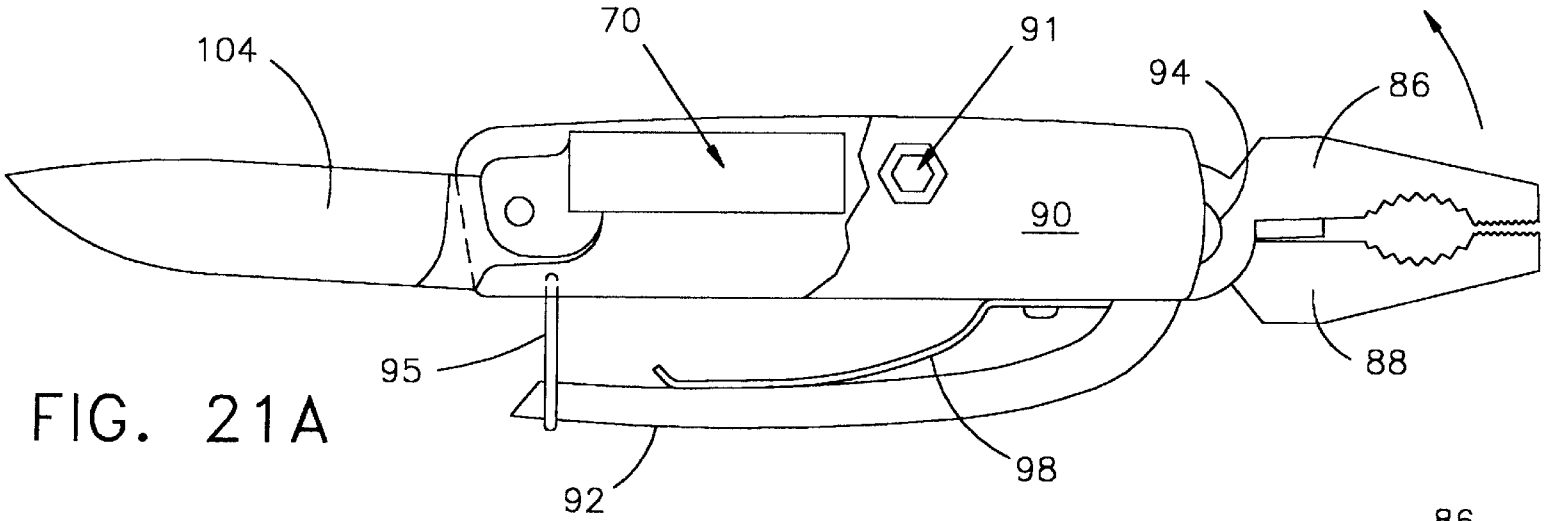
FIGS. 21A and 21B are views similar to that of FIG. 21 and 22, but with a centrally disposed-crossbore on one handle for driving both the hexagonal driver sleeve and the hexagonal driver bit transversely to the axis of the tool handle.
Figure 21B:
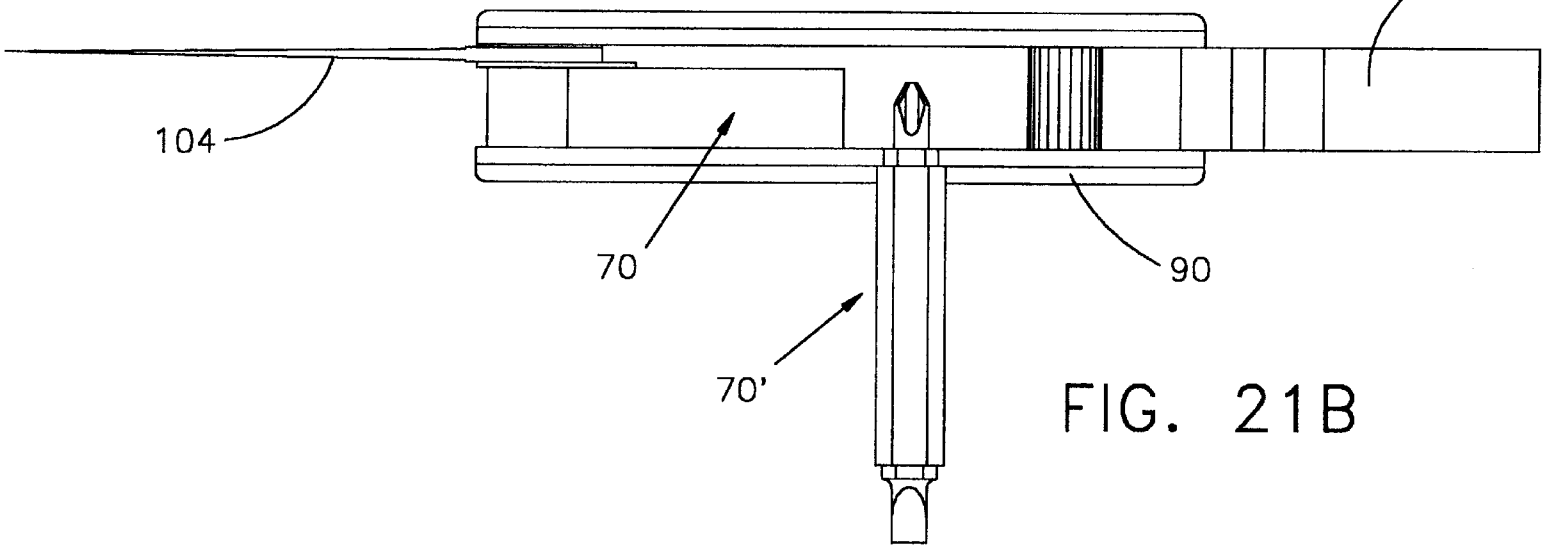

The fixed handle 90 is suitably equipped with a plurality of pivotable tool implements, such as a large knife 104 and a 4 in 1 or 8 in 1 driver tool, similar to that shown in FIGS. 6 and 15–19. The releasable locking mechanism (not shown) for holding such tool implements in the open position does not form part of the invention and is well known and conventional. In the embodiment of FIGS. 21A and 21B, the 4 in 1 driver sleeve 70' with dual bits at opposite ends thereof is shown removed from the pivotable sleeve 70 and positioned in the pair of hexagonal bores 91 provided in a side of the handle 90.

FIGS. 21A and 21B show the tool also, optionally, having at least one dual transverse hexagonal crossbore 91 in one or both handle sides (one shown). The crossbore 91 is of a desired, predetermined size for mating with either or both of an hexagonal driver bit or a hexagonal sleeve-hexagonal driver bit, thereby enabling the tool be gripped about the handle with the 4 in 1 screwdriver 70' midway between a user's four fingers. With such a tool arrangement, one has greater flexibility in employing such tool for various applications of driving or un-driving fasteners. Dual hexagonal crossbores 91 enable greater torque capability, and less "slippage" and/or wearing of the hexagonal bores provided in the laminated handle sides, which are conventionally made either entirely or laminated of metal, plastic, or the handle sides could even be a combination of both materials. In any event, one hexagonal connection is adequate for driving fasteners. Of course, suitable clearance must be provided between the side walls or side bolsters for a protruding drive bit, and there can be no interference with any of the other pivotable elements or tools in the folding hand tool. Nevertheless, depending upon the size of the tools and the handle length, a tool can be pivoted into the open position, if necessary for clearance.

Figure 15:
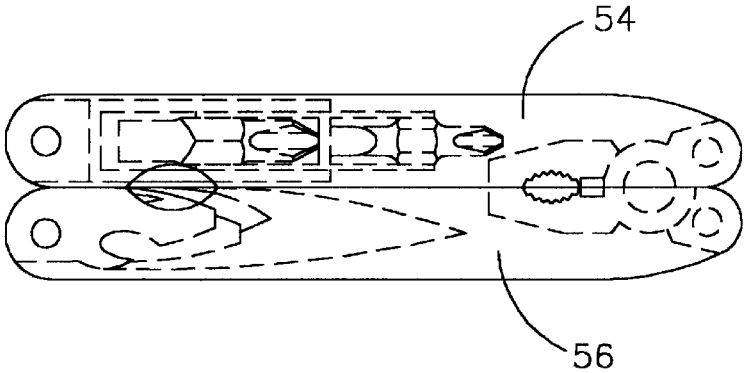
FIG. 15 is a side elevational view of the hand/survival tool shown in FIG. 14, but with all tool implements and/or blade-like devices folded into the pivoted and linked pair of handles (with all of the innards shown in phantom).
Figure 16:
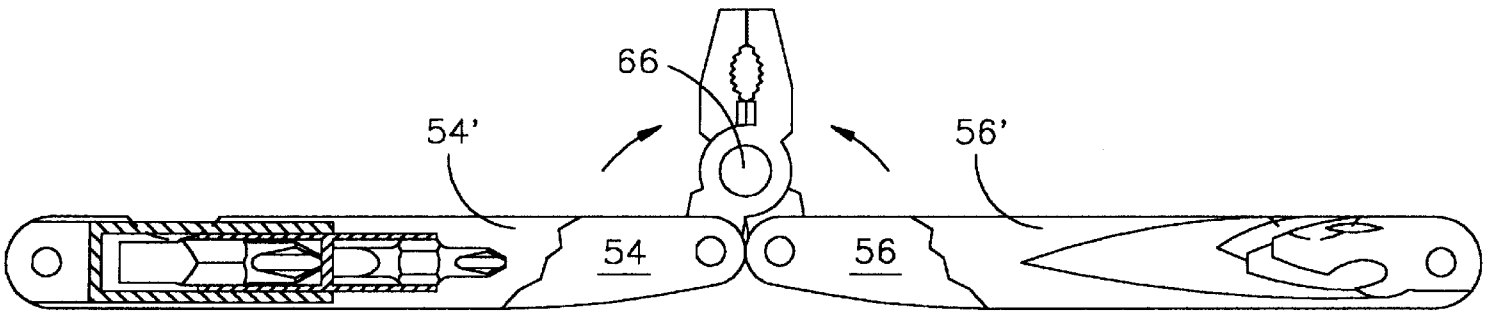
FIG. 16 is a side elevational view, similar to that of FIG. 15, but partially broken away, and showing both handles folded outwardly about 90 degrees.
Figure 17:
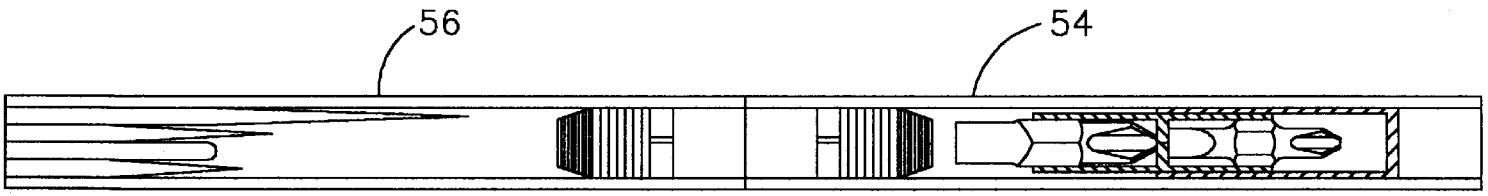
FIG. 17 is a bottom view or a view looking into the handle cavities or compartments and showing all of the tool implements and/or blade-like devices folded into their storage positions, and with the plier-like jaws shown also pivoted back into their respective portions of the handle cavities or compartments.
Figure 18:
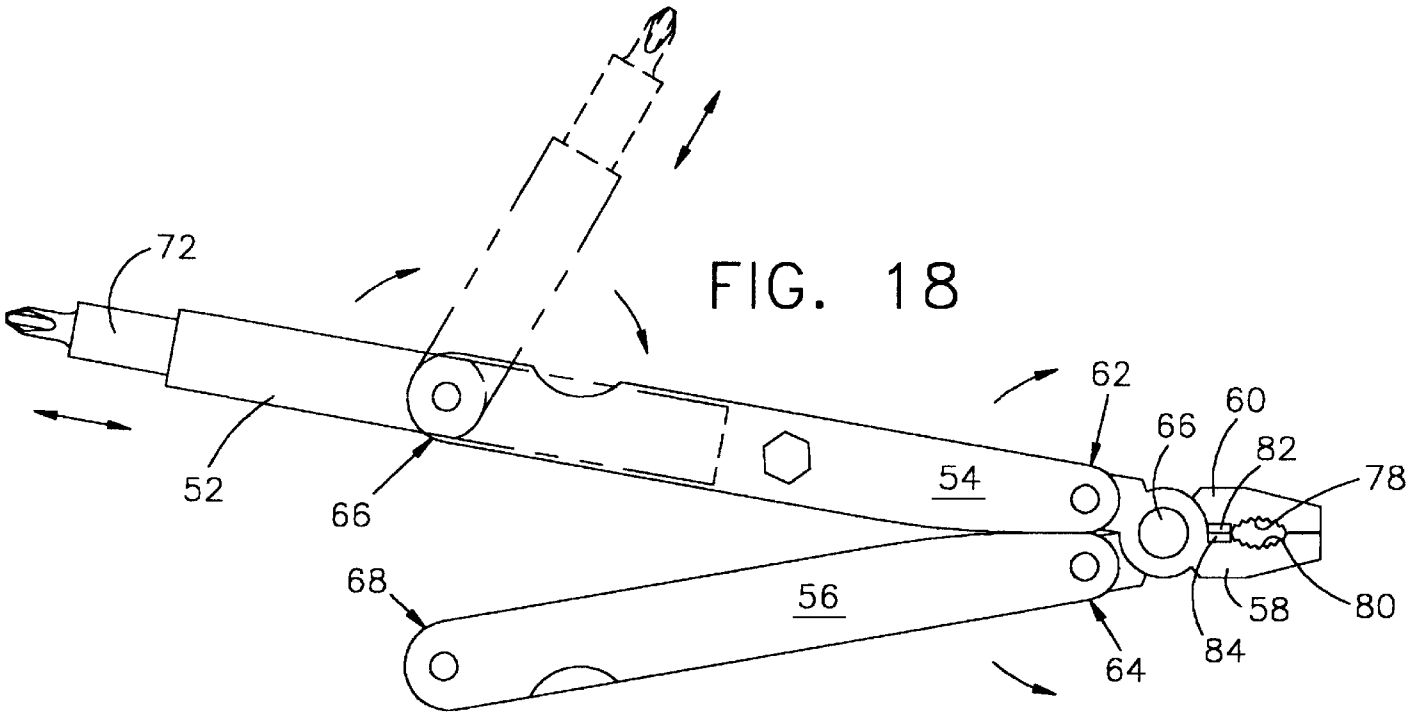
FIG. 18 is a side elevational view of the hand/survival tool shown in FIGS. 14–17, but with both handles folded about 180 degrees from their stored/folded abutting position, and with a 4 in 1 screwdriver tool shown both in its locked, fully extended operative use position, and in phantom at about 75 degrees, and in its stored position without the 4 in 1 screwdriver tool.
Figure 19:
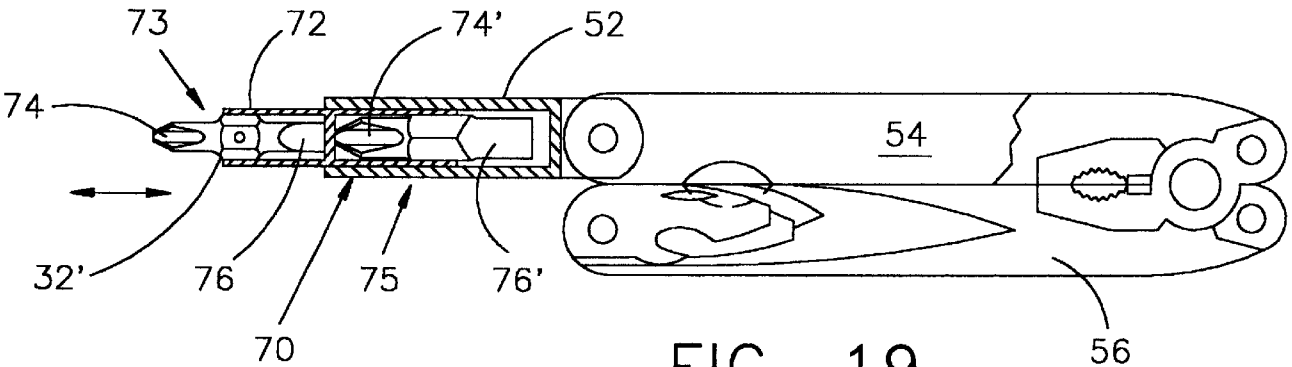
FIG. 19 is a side elevational view, similar to that of FIG. 15, but with the pair of handles, shown partly broken away, to illustrate the stored tool implements; and with the 4 in 1 screwdriver tool shown in section in its extended operative position for use by the user with one of the two sized Phillips head screwdriver bits.
Figure 24:
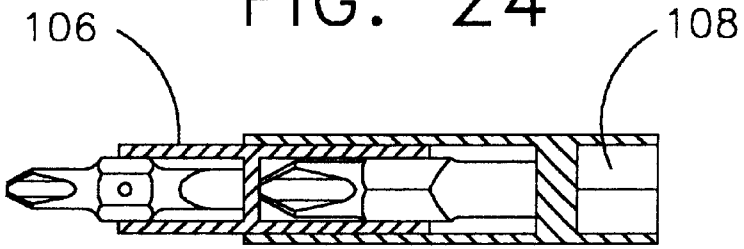
FIG. 24 is a sectional view of the driver/holder of FIG. 23, and showing therein a pair of hexagonal bits retained at opposite ends in their respective hexagonal compartments.
Figure 23:
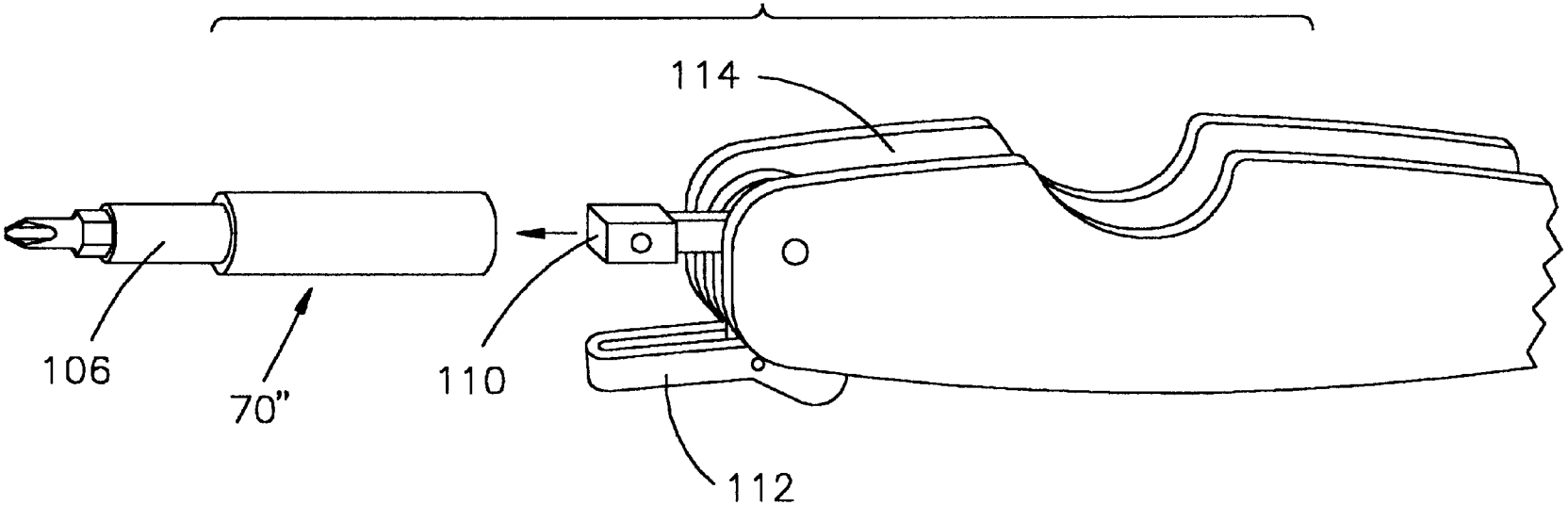
FIG. 23 is an exploded view of an alternate version of the invention where the cylindrical compartmented hexagonal sleeve member of the 4 in 1 bit driver/holder is independent of the knife handle, and is removably attached to a driver suitably pivotally mounted in the handle with conventional means for locking the driver in the in-line position with the handle.
Figure 25:
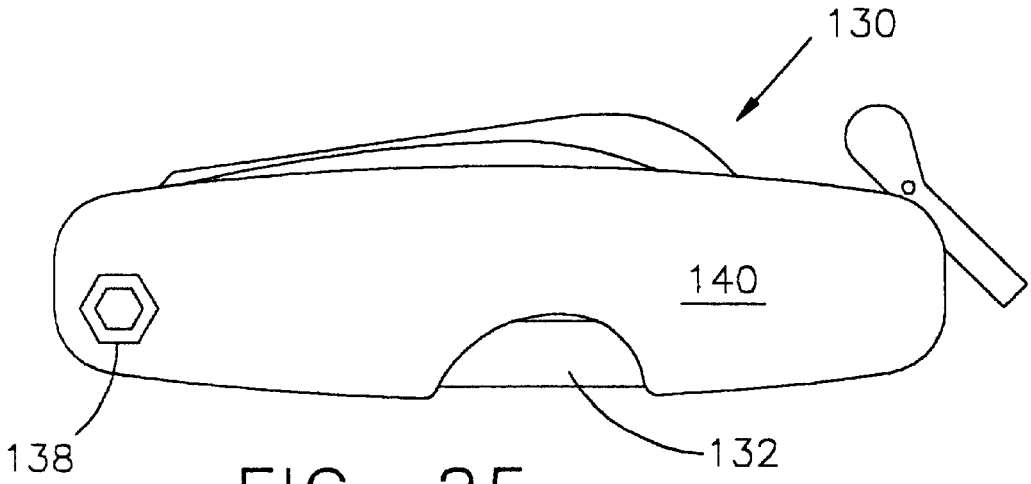
FIGS. 25–27 are other various view of the invention; and showing in such figures, particularly that of FIGS. 25 and 26 a dual crossbore at one end of the tool handle for mating with both the hexagonal driver sleeve and one of the hexagonal bits; and with this arrangement, greater torque than that of FIG. 21B would be available to the user due to the longer "lever arm" of the tool handle. Also, the hexagonal sleeve element provides a greater "extension" to the bit being driven.
Figure 26:
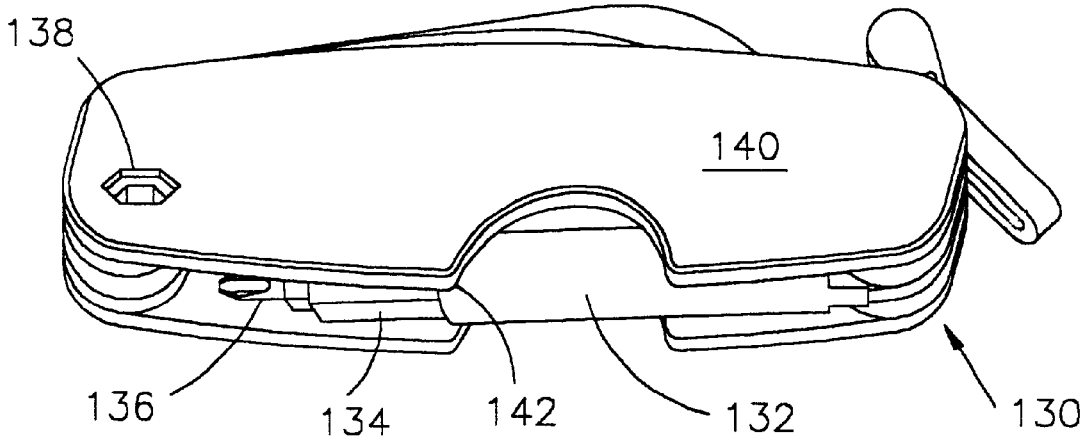
Figure 27:
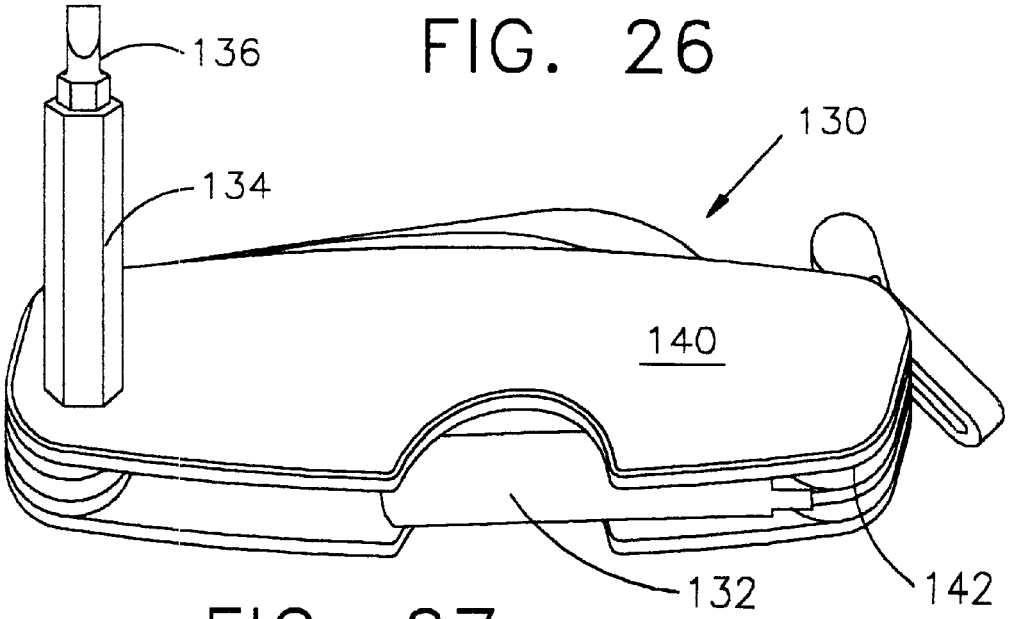

In FIGS. 23, there is shown, partly broken away, an exploded view of a variation of the folding tool wherein just one of the tools provided, that is, the 4 in 1 driver tool 70" is only illustrated. Here such driver tool 70" is not fixedly pivoted to an end of the tool handle, but is removably connected by suitable ball detent means (or magnets or by retaining clips) to a polygonal socket connection-drive means 110 for the 4 in 1 driver tool 70", such as hexagon or square as shown. Of course, mating grooves and ears as shown in FIG. 15 could also be used. The inner sleeve 106 and its drive bits are the same as that of the 4 in 1 driver tool 70 of FIGS. 14–22, as shown, the inner sleeve 106 is also suitably secured by ball detent or other said means noted herein, for example, to the outer sleeve; and is suitably precluded from rotating with respect thereto so as to transmit torque therethrough by means of a pair of mating grooves 51 in the outer sleeve and a matching pair of protruding ears 53 on the inner sleeve (not shown), but same is well known in the art, and illustrated in FIG. 14 for convenience. FIG. 24 simply shows the female square 108 at one end of the driver tool 70'. U-shape element 112 is conventional and is connectable to a conventional flat cam-like element (not shown) for facilitating the locking and pivotable movement of the square socket connection-drive means 110 from the closed stored condition to the open, longitudinally extending locked position. While such well known "linkage" can be used for other tools of the improved hand/survival tool of the invention, here in the present application, it is just employed for the square drive means 110 which is small and difficult to reach and pull out of the cavity/compartment 114 where one's fingers are large and/or to big for grasping the drive means 110 and pulling same out of its storage position in the cavity or compartment between the two flat handles or bolsters of the improved folding/survival tool of the invention.

Figure 7:
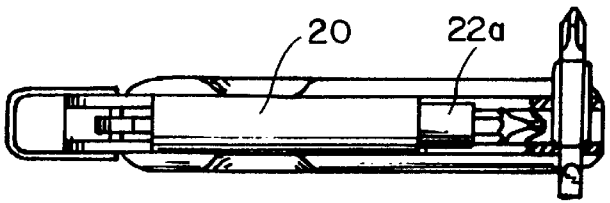
FIG. 7 is a top view of the folding knife and interchangeable bit screwdriver of the invention of FIG. 6, showing the sleeve-in-sleeve and a bit in closed position and a bit in offset position.
Figure 12:
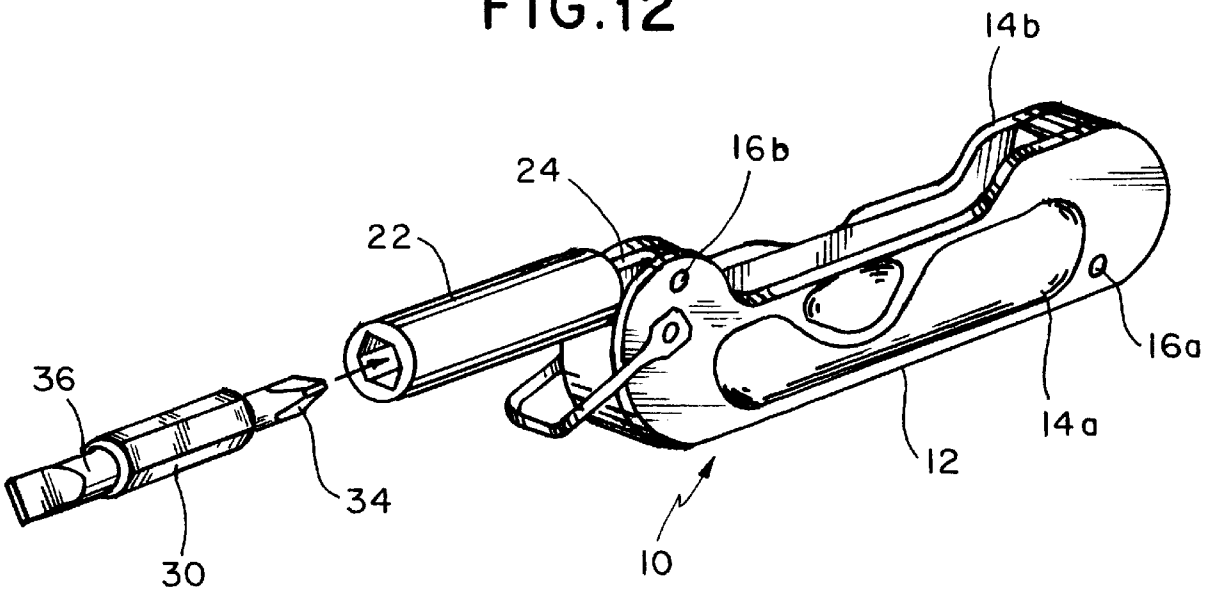
FIG. 12 is a perspective view of a magnetic retainer version of the folding knife and interchangeable bit screwdriver of the invention.
Figure 13:
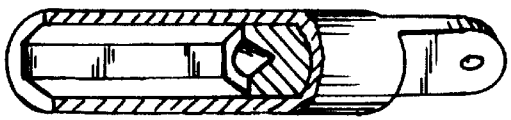
FIG. 13 is a perspective fragmentary view, partly broken away, of the magnetic retainer version of the folding knife and interchangeable bit screwdriver of the invention.
Figure 14:
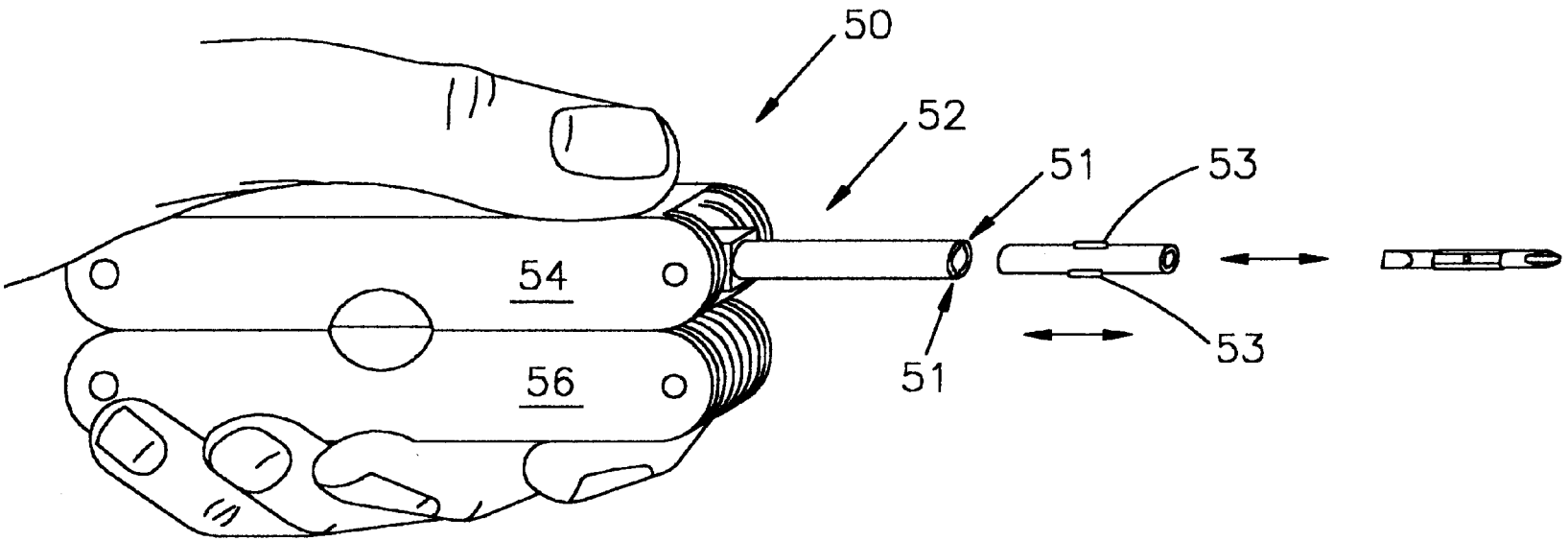
FIG. 14 is a perspective, partially exploded view of the improved hand/survival tool with multiple functions/purposes, and with a 4 in 1 interchangeable screwdriver shown in one of the hinged or folding blade-like implements forming part of the hand tool.

Sleeve 22*a* is disconnectably attached to sleeve 20 or tube 22 which has a hexagonal (polygonal) internal end 26 (see FIGS. 4, 6 and 7). This construction provides a means for disconnectably attaching the sleeve means. Hinge pin 16*b* and hinged end 24 provide a means for pivotally connecting the means for disconnectably attaching the sleeve means to the handle (see FIGS. 4, 6 and 7). See also FIGS. 23–24 and 35–37 for other means for pivotably connecting and disconnectably attaching the sleeve means.

Figure 28:
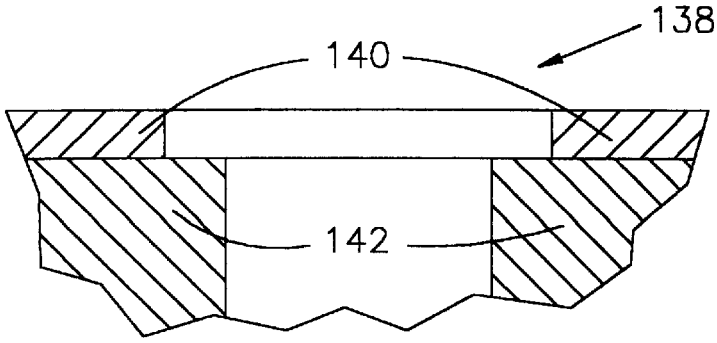
FIG. 28 is a partial sectional view showing a "laminated" tool handle with the crossbore driver aperture formed in a plurality of planes, such as those formed by two metal plates.
Figure 29:
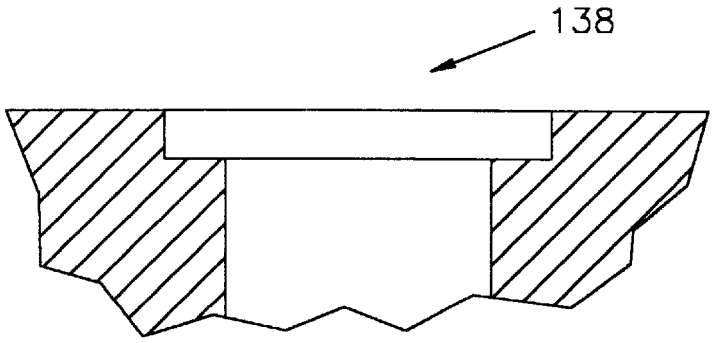
FIG. 29 is a view, similar to that of FIG. 28, but showing two hexagonal bores in the same or like material, such as plastic, although metal, steel or other material could be used.
Figure 30:
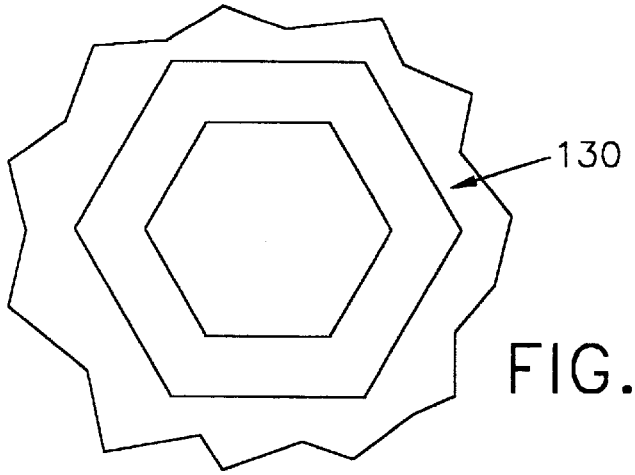
FIG. 30 is an enlarged plan view, broken away, of just the crossbores of FIGS. 28 and 29 showing their coaxial bores or hexagonal shapes which are in coincidence with respect to each other for mating with the hexagonal shapes of both a driver bit and a hexagonal driver element/sleeve where the tool desired requires a longer extension or reach (see FIG. 31).
Figure 31:
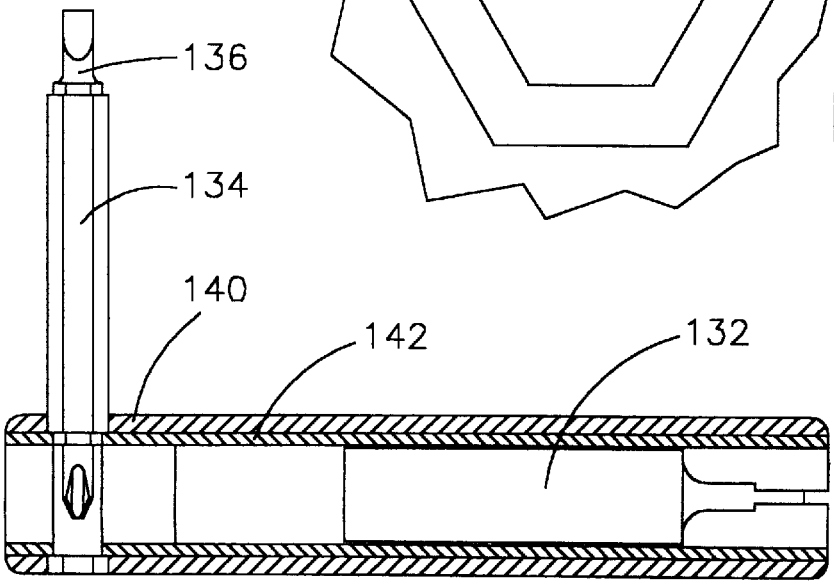
FIG. 31 shows in section the dual driving surfaces of the hexagonal crossbores in both sides of the laminated tool handles (similar to that shown in FIG. 21B).

In FIGS. 25–31, one or more, differently sized, dual crossbore 138 (one shown) is suitably positioned at one end of a folding tool so as to provide maximum lever advantage to the user. In all other respects, the embodiment of such FIGS. 25–28 is similar to that of FIG. 21B where both an inner hexagonal sleeve and the hexagonal bits are employed to transfer torque from one turning the tool handle to transmission through the bit and sleeve to a fastener being driven or undriven. FIGS. 28 and 29 show partial cross-sectional views of a laminated handle (FIG. 28) and a one-piece handle side (FIG. 29), with FIG. 30 showing in plan view the dual hexagonal crossbore which mate with a 4 in 1 driver sleeve and one of its hexagonal drive bits.

As shown in FIGS. 25–31, the folding knife/tool 130 of the invention is suitably provided with various knives, bottle and can openers, etc. as well as either a 4 in 1 or 8 in 1 driver tool which employs a pivotable outer sleeve 132 and inner hexagonal sleeve 134 with its oppositely disposed drive bits 136 (one shown). In this tool, suitable dual crossbores 138 may be positioned in the laminated sides 140, 142 of the handle, thereby enabling transmission of torque transverse to the handle axis when the inner hexagonal sleeve 134 and drive bit 136 are engaged with the crossbores 138. Considerable mechanical advantage is achieved when the improved tool of the invention is employed in this manner.

Note that FIG. 28 shows broken away a greatly enlarged cross-sectional view of the laminated metallic sides 140, 142 (see also FIGS. 25–27 and 31). FIG. 30 is simply an illustration of the hexagonal crossbores 130 in the laminated plates 140 and 142.

Figure 32:
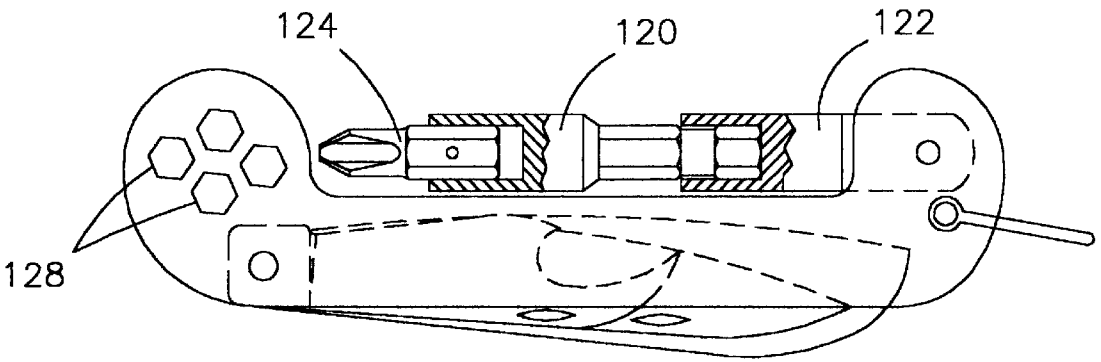
FIGS. 32–34 are views of a further folding knife tool having a "chuck" or bit holder which is removably connected to a pivotable element. The entire element and "chuck" can be stored within the cutout bay of the tool handle, and anyone of a plurality of drive bits (one shown) stored in the transverse crossbore can be substituted for the drive bit connect to the "chuck".
Figure 33:
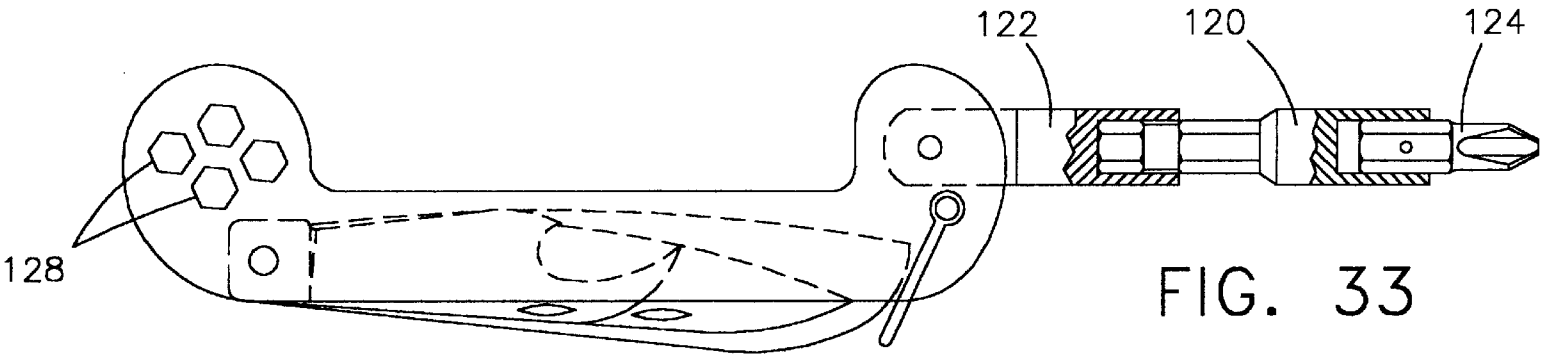
Figure 34:
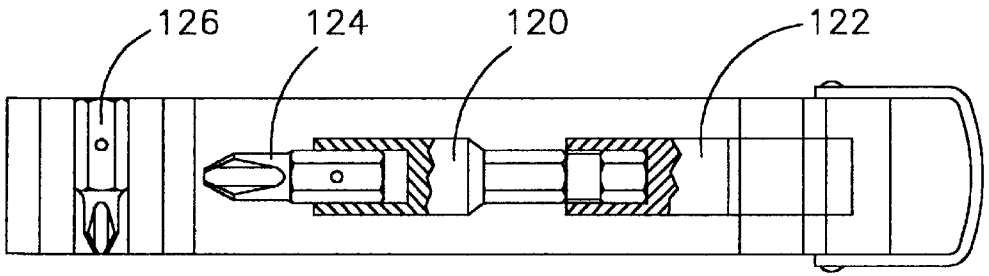

In FIGS. 32–34, a further improved folding tool has a large cutout bay for a conventional bit "chuck" 120 which is removably securable by well known means to a pivotable outer sleeve like element 122 which may be provided with a hex or square bore for torque-transmission. The hexagonal driver bit 124 is seated in the hexagonal inner bore of the chuck 120 and held therein by a suitable ball detent, magnets, retaining clips or the like. A plurality of drive bits 126 (one shown) may be suitably stored and held by the aforesaid ball detent means in a plurality of hexagonal through bores 128 passing through the body of the tool from side to side. Thus, in the embodiment shown, five bits could be conveniently stored, one in the chuck and four in the tool itself. If desired, other additional bits can be placed in crossbores where space is available and does not interfere with action of any of the tools. However, if desired, one can separately carry with the tool itself extra bits in a pouch for holding the tool and the extra bits of various sizes and/or shapes or styles, such as those well known in the marketplace (star or Torx, pin-type, Phillips, flat, etc.).

In FIGS. 35–38, an improved shorter version plier-like tool 146, such as the Leatherman type of FIGS. 14–19, but with a suitable hexagonal drive means 110' (similar to the square drive means of FIG. 23). In a like manner, this embodiment may utilize in lieu of a square or hexagon drive means mating grooves and engaging protruding wings or ears for transmitting rotational motion therebetween. Such drive means 110' may be male or female, pivotable or not, protruding or recessed, polygonal or otherwise so shaped for transmitting torque (such as mating grooves and ears), and may also be suitably provided with a conventional flat cam-like element (not shown) for facilitating the pivotable movement of the square socket convention-drive means 110' from the closed stored condition to the open, longitudinal extending locked position. The removable driver tool 70" drives the mating hexagonal inner sleeve 106' which in turn drives either of the hexagonal bits from its inner hexagonal cavities. Case 148, suitably of leather, with a "snap-like" closure cover 150 has a pair of pockets as shown for holding the plier-like tool 146 and the removable driver tool 70'". Of course, it will be appreciated that the distal end mating connection for the driver tool element may be male or female or vise-versa, such as similarly shown in FIG. 32.

Figure 39:
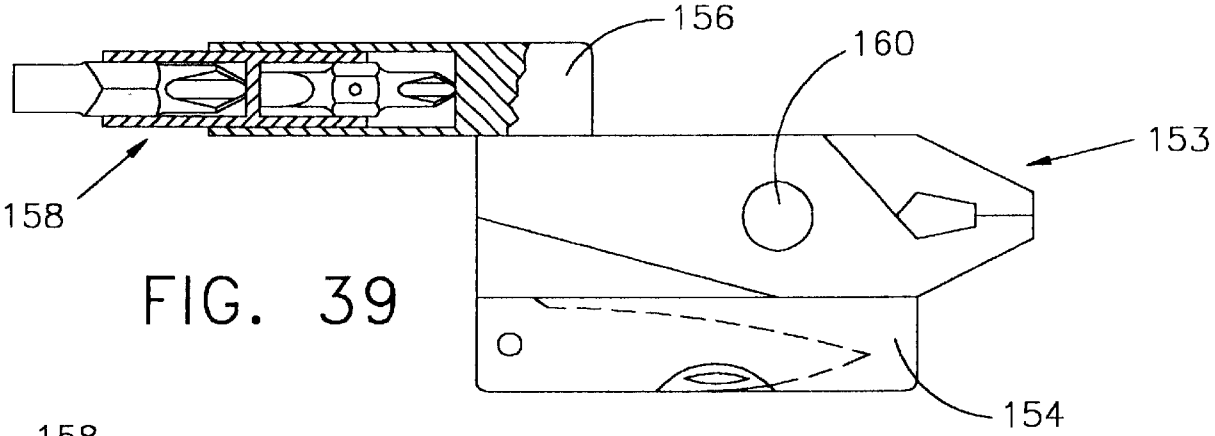
FIGS. 39 and 40 are side elevational views, partly in section, of an alternate more compact, plier hand tool, but with handles having storage cavities, and which pivot perpendicularly to that of the pivot axis of the plier jaws.
Figure 40:
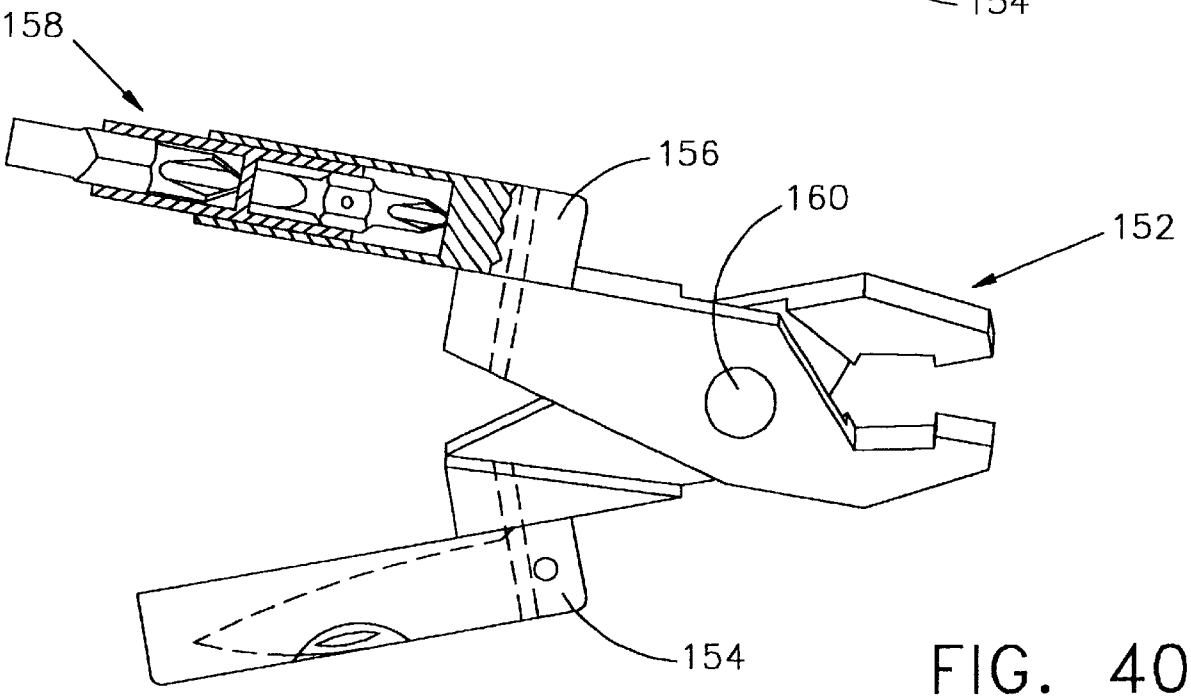

In FIGS. 39–40, other improved tools are illustrated and these are all equipped with at least one 4 in 1 or 8 in 1 type driver tool depending upon the size of the tool desired. For example, the collapsible/foldable clamp embodiment 152 of FIG. 40 as well as the plier embodiment 153 of FIG. 39 are each equipped with pivotable distal leg portions 154, 156 having hollow cavities for either a knife as shown therein or other tools, such as the 4 in 1 screwdriver tool 158, which is similar to that of the screwdriver tools shown in FIGS. 14–19, and 20–22. Here, however, the pivot axes of the legs 154, 156 are on axes transverse to that of the jaws pivot 160 which is in contrast to the print axes of the handles 54, 56 of FIGS. 14–19 which are parallel to that of the jaws 58, 60 of such other Leatherman type tool embodiment.

Figure 41:
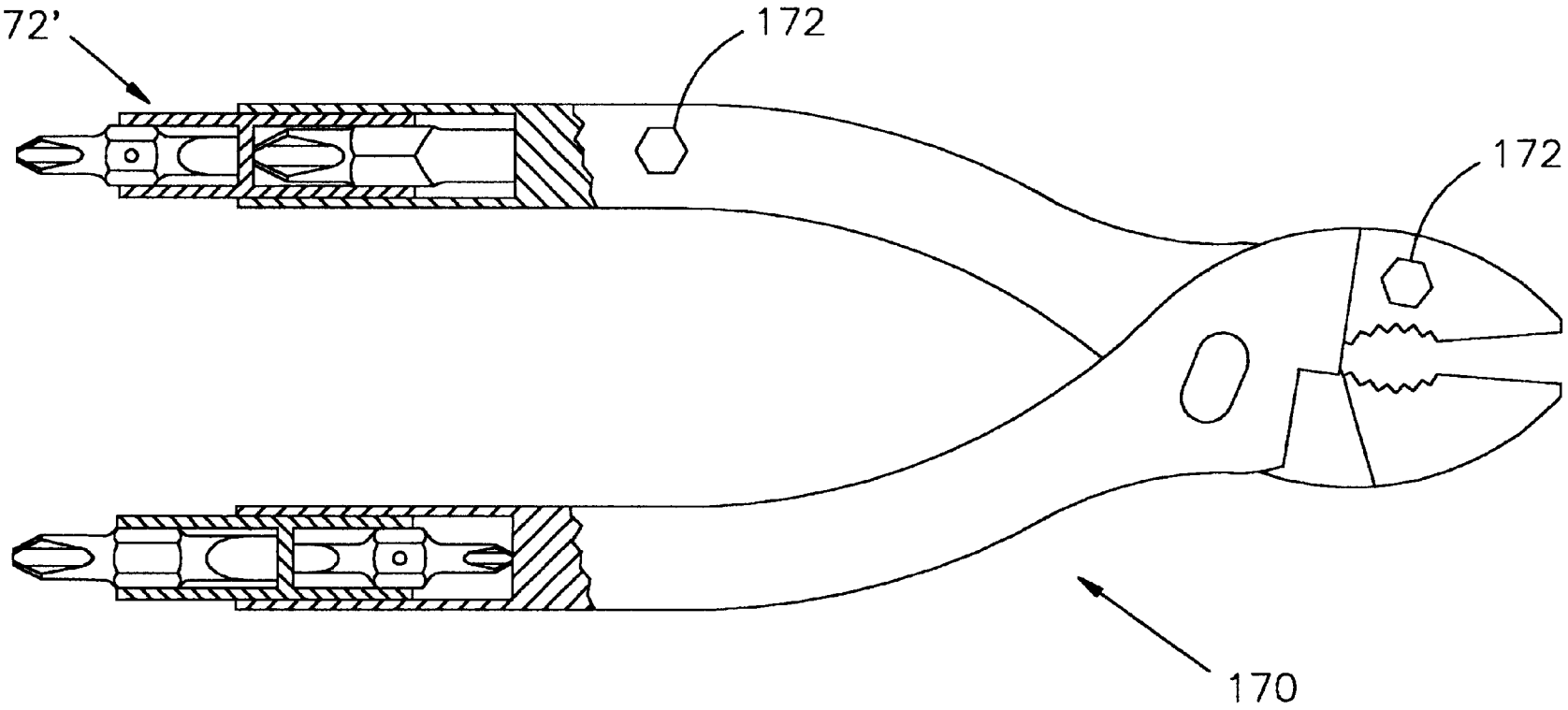
FIG. 41 is a side elevational view of a more conventional type pliers, but with handles having hollowed distal end portions for containing either 4 in 1 or 8 in 1 bit drivers of either the blade type or the nut types.

In the plier tool 170 embodiment of FIG. 41, each leg thereof is hollow at its distal end for supporting therein a 4 in 1 screwdriver tool or other type of driver tool such as a nut driver or any combination thereof, such as those disclosed in our aforesaid copending U.S. patent application. Such plier tool 170 may also be equipped with one or more hexagon cross-bore holes 172 for enabling the hexagonal central portion of a tool bit to be suitably held therein, and using the handles of the plier tool as a fulcrum-lever aid for torquing a bit as required in driving/undriving a fastener or nut. The inner sleeve 72' with its dual bits is similar to that shown with respect to FIGS. 14–22.

Figure 42:
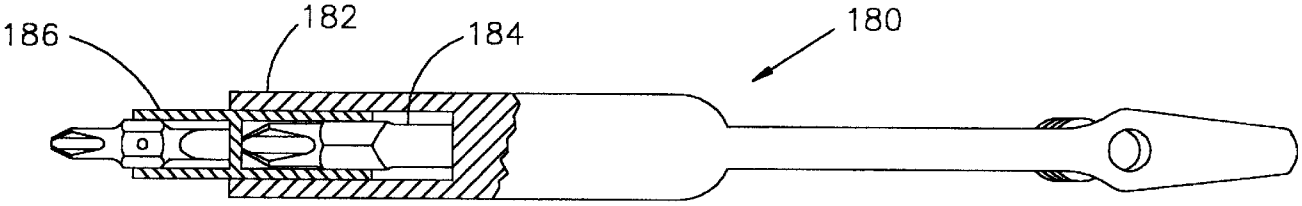
FIGS. 42–44 are various views of an adjustable type monkey wrench embodiment, partly in section so as to more particularly illustrate the 4 in 1 screwdriver tool shown at the distal end of the wrench handle.
Figure 43:
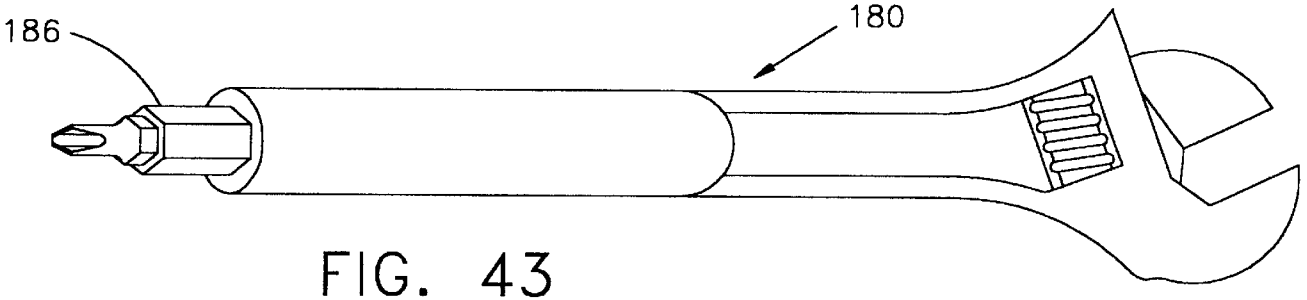
Figure 44:
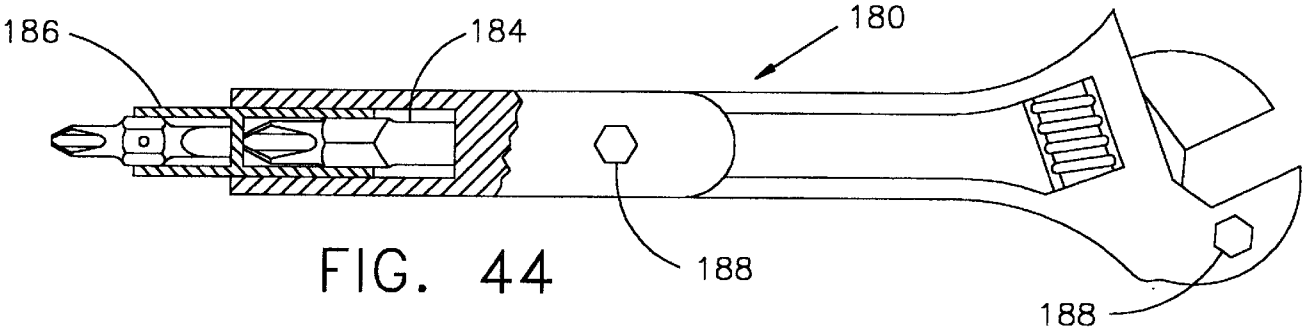

In the embodiment of FIGS. 42–44, there is shown an adjustable wrench 180 with its distal end handle 182 having hollow cavity 184 for mating with the reversible hexagonal sleeve 186 holding at opposite ends thereof a pair of reversible bits. This tool is also suitably provided with one or more hexagon cross-bore holes 188 similar to that of the tool of FIG. 41 except with one hole in the fixed jaw and the other hexagonal hole in the handle.

Although the present invention has been described in some detail by way of illustration and example for purposes of clarity and understanding, it will of course be understood that various changes and modifications may be made in the form, details and arrangements of the parts without departing from the scope of the invention as set forth in the following claims.

What is claimed is:

1. A hand tool comprising;

a handle having an elongated hand grip portion, said hand grip portion having oppositely disposed ends;

a first tool comprising;

a plurality of tool bits, and further comprising sleeve means for operably holding at least one of said tool bits, and means for disconnectably attaching said sleeve means adjacent one hand grip portion end, and means for pivotally connecting said means for disconnectably attaching said sleeve means to said one hand grip portion end; and a second tool comprising;

means for pivotally connecting the second tool to the other and of said hand grip portion and having a pivot axis disposed adjacent the other end of said hand grip portion;

whereby the hand tool is operable as a drive tool or a second tool.

2. The hand tool of claim 1, said second tool being pivotable away from said hand grip portion to be operable disposed.

3. The hand tool of claim 1, said sleeve means being formed with a hexagonal inner surface for receiving said one of said tool bits.

4. The hand tool of claim 1, said first tool and said second tool being disposed in about the same plane.

5. The hand tool of claim 1, said tool bits being interchangeable.

6. The hand tool of claim 1, said means for disconnectably connecting said sleeve means being formed with a polygonal end portion for slidably receiving said sleeve means.

7. The hand tool of claim 6, said polygonal end portion comprises four contiguous surfaces.

8. The hand tool of claim 1, each said tool bit having a central hexagonal body portion and oppositely disposed drive ends.

* * * * *